US009194034B2

(12) United States Patent
Steins et al.

(10) Patent No.: US 9,194,034 B2
(45) Date of Patent: Nov. 24, 2015

(54) METHOD AND APPARATUS FOR HEATING A PRE-COATED PLATE OF STEEL

(71) Applicant: Benteler Automobiltechnik GmbH, Paderborn (DE)

(72) Inventors: Christoph Steins, Lichtenau (DE); Matthias Rode, Hoevelhof (DE); Markus Pellmann, Sassenberg (DE); Karsten Bake, Delbrueck (DE); Christian Hielscher, Delbrueck (DE)

(73) Assignee: BENTELER AUTOMOBIL TECHNIK GmbH, Paderborn (DE)

( * ) Notice: Subject to any disclaimer, the term of this patent is extended or adjusted under 35 U.S.C. 154(b) by 301 days.

(21) Appl. No.: 13/621,644

(22) Filed: Sep. 17, 2012

(65) Prior Publication Data

US 2013/0068350 A1 Mar. 21, 2013

(30) Foreign Application Priority Data

Sep. 15, 2011 (DE) ..... 10 2011 053 634

(51) Int. Cl.

| | |
|---|---|
| ***C21D 1/76*** | (2006.01) |
| ***C23C 8/10*** | (2006.01) |
| ***C23C 2/26*** | (2006.01) |
| ***C23C 2/28*** | (2006.01) |
| ***C21D 9/46*** | (2006.01) |

(Continued)

(52) U.S. Cl.

CPC ... *C23C 8/10* (2013.01); *C21D 1/76* (2013.01); *C21D 9/46* (2013.01); *C22C 38/02* (2013.01); *C22C 38/04* (2013.01); *C22C 38/06* (2013.01); *C22C 38/14* (2013.01); *C22C 38/22* (2013.01); *C22C 38/28* (2013.01); *C22C 38/32* (2013.01); *C22C 38/38* (2013.01); *C23C 2/26* (2013.01); *C23C 2/28* (2013.01); *C21D 2241/00* (2013.01)

(58) Field of Classification Search

CPC ..... C23C 8/10; C23C 2/26; C23C 2/28; C23C 38/00; C21D 1/76; C21D 9/46; C21D 2241/00

USPC ..... 148/276, 278, 284, 533; 427/319, 320, 427/321

See application file for complete search history.

(56) References Cited

U.S. PATENT DOCUMENTS

| | | | |
|---|---|---|---|
| 2,768,916 | A | 9/1956 | Seabold et al. |
| 5,688,305 | A | 11/1997 | Graeff |

(Continued)

FOREIGN PATENT DOCUMENTS

| | | |
|---|---|---|
| DE | 1 187 099 B | 2/1965 |
| DE | 1 803 211 | 6/1969 |

(Continued)

OTHER PUBLICATIONS

Rolf Schwarz: "Entwicklungstendenzen beim Presshärten in der Automobilindustrie", (emerging technologies in the hot pressing and tempering of sheet metal) Umformtechnik Mar. 2006, pp. 38-41.

(Continued)

*Primary Examiner* — Lois Zheng

(74) *Attorney, Agent, or Firm* — Henry M. Feiereisen LLC

(57) ABSTRACT

A pre-coated plate of steel is heated in a furnace to form an intermetallic alloying layer on the plate at least in an area thereof. Air is pretreated through drying to produce dried air which is fed into the furnace to control the atmosphere within the furnace while the pre-coated plate is in the furnace.

13 Claims, 2 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/14*** | (2006.01) |
| ***C22C 38/22*** | (2006.01) |
| ***C22C 38/28*** | (2006.01) |
| ***C22C 38/32*** | (2006.01) |
| ***C22C 38/38*** | (2006.01) |
| *C22C 38/00* | (2006.01) |

(56) References Cited

U.S. PATENT DOCUMENTS

| | | | |
|---|---|---|---|
| 6,224,692 | B1 | 5/2001 | Cantacuzene |
| 6,843,836 | B2 | 1/2005 | Kitchener |
| 7,867,344 | B2 | 1/2011 | Kusumi et al. |
| 2010/0175794 | A1 | 7/2010 | Sepeur et al. |

FOREIGN PATENT DOCUMENTS

| | | | |
|---|---|---|---|
| DE | 26 36 639 | | 2/1978 |
| DE | 44 37 494 | A1 | 4/1996 |
| DE | 198 16 311 | B4 | 4/1999 |
| DE | 198 08 011 | C1 | 2/2000 |
| DE | 101 96 063 | T1 | 3/2003 |
| DE | 699 12 698 | T2 | 9/2004 |
| DE | 699 33 751 | T2 | 10/2007 |
| DE | 10 2007 038 215 | | 2/2009 |
| DE | 10 2011 006 171 | A1 | 9/2012 |
| EP | 1 013 785 | B1 | 6/2000 |
| EP | 1 790 422 | | 5/2007 |
| GB | 1225690 | | 3/1871 |
| GB | 777881 | | 6/1957 |
| JP | 858-055026 | A | 4/1983 |

OTHER PUBLICATIONS

Harald Lehmann & Rolf Schwartz: "Rollenherdöfen für das Presshärten", (roller hearth furnaces for hot pressing and tempering of sheet metals), 3rd Erlanger Workshop on hot forming of sheet metal) 2008 DFG), published by Merklein, M., Meisenbach Bamberg 2008, pp. 57-65.

"Luft" (air) www.wikipedia.org, (Oct. 16, 2013).

METHOD AND APPARATUS FOR HEATING A PRE-COATED PLATE OF STEEL

CROSS-REFERENCES TO RELATED APPLICATIONS

This application claims the priority of German Patent Application, Serial No. 10 2011 053 634.5, filed Sep. 15, 2011, pursuant to 35 U.S.C. 119(a)-(d), the content of which is incorporated herein by reference in its entirety as if fully set forth herein.

BACKGROUND OF THE INVENTION

The present invention relates to a method and apparatus for heating a pre-coated plate of steel.

The following discussion of related art is provided to assist the reader in understanding the advantages of the invention, and is not to be construed as an admission that this related art is prior art to this invention.

Production of hot formed structural parts is based on plastic formation of mostly flat semi-finished products. Unlike cold forming at room temperature, the preceding heating of metallic semi-finished products in particular prevents the presence of unwanted solidification and decreased ductility in the forming zone. In addition, heating facilitates a targeted change in shape of the semi-finished product because the reduced strength of the used material, when heated, substantially avoids the presence of possible shearing or cleavage fracture.

Steel plates provide in particular in the automobile industry the basis for manufacturing body or structural parts. Besides corrosion protection, ecological and economic considerations dictate an increasing need for high-strength structural parts which have a beneficial ratio of strength to weight. Mechanical resistibility can be increased by hardening the material through heating and subsequent rapid quenching to cause a change in position of the carbon atoms in the metal lattice. This positional change begins when the austenitization temperature is reached, with subsequent quenching producing a martensitic hardened microstructure to thereby significantly increase the strength of the formed structural part. The required cooldown rate is hereby dependent on the respectively used alloy.

When the use of thin-walled plates of steel is involved, form or press hardening has established itself as an economical process to hot form metal sheets. The heated plate is placed in a forming tool to undergo the forming process and hardening as it is quenched. To prevent decarburization and oxidation of steel during heating, the latter is carried out in the presence of a controlled atmosphere, for example nitrogen. Heating may, however, also take place in the presence of ambient air so long as the plate has been suitably coated prior to undergoing the heating process, for example with a coating of aluminum or aluminum alloy such as aluminum and silicon.

The use of oxides as passive corrosion protection on the surface of metals is generally known. In order to obtain the positive properties of oxides also on a surface of a coating, exposure to atmospheric oxygen is desired during heating. However, nitrogen naturally contained in the ambient air forms together with aluminum or an alloy of aluminum and silicon of a coating very hard deposits which adhere to the forming tool. For the surface quality of structural parts being produced to not deteriorate, the tools have to be cleaned. This causes not only stoppage and set-up and maintenance works, but a removal of hard deposits requires also grinding of the forming tool zones so that wear is significantly increased. As the furnace atmosphere is heated, the contained oxygen proportion is decreased at least in some areas so that the formation of the desired oxide layer on the coating is limited. As a result, the oxide layer is unable to fully develop in order to counteract the adherence of the coating on the forming tool so that added deposits are encountered.

In addition, as the aluminum oxide layer is not fully developed and partly detaches, dust is increasingly formed, causing increased wear through abrasion of the guided and/or bearing-mounted components of the forming tool. Thus, guides of slides or brakes of the forming tool for example are subject to increased wear. Due to the uncontrolled atmosphere inside the furnace, a respective water fraction in the form of water vapor is encountered as a result of an exchange with the ambient air. Water is broken down by thermal stress inside the furnace and leads to an increased proportion of hydrogen which can cause hydrogen embrittlement of the steel. For economical reasons, the furnace is built with small openings for charging and discharging so that only a small fraction of atmospheric oxygen is able to migrate into the furnace and thus again the formation of an advantageous oxide layer on the coating is limited.

It would therefore be desirable and advantageous to provide an improved method and apparatus for heating a pre-coated plate of steel to obviate prior art shortcomings and to reduce wear of a forming tools as a result of deposits and to reduce abrasion while yet to enable the formation of a sufficient oxidation of the coating and to reduce the risk of hydrogen embrittlement in an economic manner.

SUMMARY OF THE INVENTION

According to one aspect of the present invention, a method includes heating a pre-coated plate of steel in a furnace to form an intermetallic alloying layer on the plate at least in an area thereof, pretreating air through drying to produce dried air, and feeding dried air into the furnace to control an atmosphere within the furnace while the pre-coated plate is in the furnace.

The present invention resolves prior art problems by reducing the proportion of dissolved water in the form of water vapor within the furnace atmosphere. As less water is broken down in the atmosphere of the furnace, it follows necessarily that less hydrogen is produced. By decreasing the fraction of hydrogen in the furnace atmosphere, hydrogen embrittlement of the steel plate as a result of penetration of hydrogen into the material becomes less of an issue. The supply of dried ambient air increases the fraction of oxygen inside the furnace atmosphere compared to the supply of nitrogen so that the desired formation of the oxide layer on the coating is realized. The presence of the oxide layer in accordance with the present invention reduces adherence of the coating to the shaping zones of the forming tool, and in addition is less likely to detach and cause dust buildup so that moving and supported parts of the forming tool are less subject to abrasion.

The coating may involve an aluminum alloy, in particular an aluminum-silicon coating. The pre-coated plate may be heated to a temperature between room temperature (20° C.) and 1,200° C., e.g. 700° C. This is followed by the forming process. Currently preferred is a temperature of 700° C. to 950° C., in particular an austenitization temperature AC3 to which the pre-coated plate is heated which is then formed in the forming tool and hardened by quenching. Although quenching may take place outside the forming tool, it is currently preferred to carry out the quenching process within the forming tool.

According to another advantageous feature of the present invention, the plate can be made of a steel alloy having a carbon fraction of 0.15 weight-% to 2.0 weight-%. A suitable steel alloy for the plate may include the following alloying components, expressed in weight-%:

Carbon (C): 0.18 to 0.30
Silicon (Si): 0.10 to 0.70
Manganese (Mn): 1.00 to 2.50
Chromium (Cr): 0.10 to 0.80
Molybdenum (Mo): 0.10 to 0.50
Titanium (Ti): 0.02 to 0.05
Boron (B): 0.002 to 0.005
Aluminum (Al): 0.01 to 0.06
Sulfur (S): maximum 0.01
Phosphorus (P): maximum 0.025,
remainder iron including impurities resulting from smelting.

As an alternative, the plate may be made of a steel alloy having the following alloying components in weight-%:

Carbon (C): 0.19 to 0.25
Silicon (Si): 0.15 to 0.50
Manganese (Mn): 1.10 to 1.40
Phosphorus (P): maximum 0.025,
Sulfur (S): maximum 0.015
Chromium (Cr): maximum 0.35
Molybdenum (Mo): maximum 0.35
Titanium (Ti): 0.02 to 0.05
Boron (B): 0.002 to 0.005
Aluminum (Al): 0.02 to 0.06
remainder iron including impurities resulting from smelting.

According to another advantageous feature of the present invention, the dried air can be fed to the furnace under pressure above atmospheric, wherein the pressure of the dried air can be adjusted to a value between atmospheric pressure and 8 bar inclusive. By adjusting the desired pressure above atmospheric, a desired amount of pretreated air, especially dried air, can be fed in a controlled manner to the furnace. Currently preferred is an adjustment of the pressure above atmospheric to a value between atmospheric pressure and 6 bar inclusive. As the air pressure of supplied dried air is predefined, i.e. pressure above atmospheric, the presence of a certain amount of desired elements, in particular oxygen ($O_2$) is ensured during heating of the pre-coated plate. Moreover, for example when the pressure above atmospheric is 6 bar, the existing system pressure of pressure air ducts can be used without requiring higher compression of compressed air in order to realize the desired supply into the furnace. Thus, components and variables can advantageously easily be used in an efficient manner.

The presence of applying a pressure above atmospheric has the added benefit that ambient air and possible combustion products are displaced from the furnace atmosphere. In particular, when the ambient temperature is high, the ambient air which is humid can be displaced advantageously from the furnace atmosphere. Thus, since the moisture content of air can be supplied in a controlled fashion, the furnace atmosphere can be adjusted in a desired manner.

As opposed to a control of the atmosphere through supply of nitrogen ($N_2$), it is now possible to reduce the existing infra-structure so that operating costs can be lowered. Thus, the need for nitrogen conditioning and respective filtration become superfluous for example.

According to another advantageous feature of the present invention, air can be dried in such a way that the dried air can have a dew point adjusted to a value of −70° C. to +10° C., preferably to a value between −70° C. to +5° C. Currently preferred is a dew point of the dried air between −30° C. to ±0° C. In general, a value for the dew point of the dried air of at least −10° C. has shown to be especially economical. A range between −40° C. to −10° C. for the value of the dew point of dried air results in general in a good quality while yet being cost-efficient. Depending on the demand at hand, the dew point of dried air can be adjusted in particular to a value of −70° C. to −40° C., although the process becomes more complicated and thus is accompanied with greater costs.

The dew point reflects the value for the temperature at which moisture in air as hydrogen precipitates as condensate. The ability of air to absorb water in the form of hydrogen depends in general on the temperature thereof. Especially during the summer months when the air temperature is high, the ability of air to absorb moisture is increased. In other words, warm air is able to absorb more moisture, whereas cold air is less able to contain moisture. When air is saturated by 100% with hydrogen, warm air contains more water than cold air. Regardless of the temperature of air, the respective dew point can be reduced through air drying.

According to another advantageous feature of the present invention, air fed to the furnace can be heated after being dried. If need be and depending on the configuration at hand, air may also be heated while being dried. Heating of air before drying may also be conceivable. Dried air can be heated to a temperature from 100° C. to 950° C., preferably to a temperature from 100° C. to 700° C. Currently preferred is a heating of dried air to a temperature from 100° C. to 500° C. Thus, the temperature of supplied air advantageously approaches the temperature inside the furnace so that temperature fluctuations inside the furnace atmosphere are substantially eliminated. The furnace can be operated economically as the furnace atmosphere is not or only slightly cooled down by incoming heated air. This means also that the required heating power is less than when supplying air that has not been heated beforehand.

Also, a supply of unheated air causes the furnace atmosphere in the area of the incoming air to have a temperature which is lower than the temperature inside the furnace so that heating of the plate is delayed. Advantageously, the energy of exhaust, in particular exhaust from the furnace, which has been extracted using a suitable heat exchanger, can be transferred in the form of heat to the air being supplied. For example, the exhaust duct, such as the exhaust duct of at least one burner of the furnace may be coupled in a heat-transmitting manner with the feed line for the pretreated air. The feed line of pretreated air may hereby contact the circumference of the exhaust duct, for example by arranging the feed line about the exhaust duct or parallel thereto. Heat of the exhaust can thus be transferred via respective walls of contacting lines to the air being supplied at least in some areas.

As an alternative, the feed line for the pretreated air may for example also be arranged at least in part within an exhaust duct of at least one burner of the furnace. The feed line is thus surrounded completely by heated exhaust so as to attain a greatest possible heat transfer between exhaust and pretreated air.

According to another advantageous feature of the present invention, a volumetric flow-rate of dried air, passing the furnace during heating of the plate, can be adjusted to 2.5 times a furnace volume per hour, preferably 3 times the furnace volume per hour. Currently preferred is an adjustment of the volumetric flow-rate of dried air, passing the furnace during heating of the plate, to 6 times the furnace volume per hour. Thus, air introduced into the furnace and advancing there through can be adjusted in relation to the desired volumetric flow-rate via the pressure. The furnace may be configured as a chamber furnace or rotary furnace or roller hearth furnace. Currently preferred is a configuration of the furnace as a continuous furnace. As a result, the press tool can continuously receive heated steel plates. A plate placed in the continuous furnace is hereby advanced by a transport unit, for example in the form of transport rollers, with the plate being heated in the furnace atmosphere and maintained at the temperature. As the volumetric flow-rate of dried air is introduced into the furnace and passes continuously there through, it is ensured that only the desired atmosphere prevails inside the furnace as especially the pressure above atmosphere and the flow of dried air effectively prevents a penetration of ambient air.

According to another advantageous feature of the present invention, the atmosphere can be adjusted within the furnace to have a composition which includes:

nitrogen ($N_2$) smaller or equal (≤) 85 vol-%, preferably 78 vol-%;

oxygen (O2) from 10 vol-% to 21 vol-%, preferably from 15 vol-% to 21 vol-%, particularly preferably 21 vol-%;

water vapor ($H_2O$ vapor) smaller (<) 3 vol-%, and remainder comprising carbon monoxide (CO), carbon dioxide ($CO_2$), methane ($CH_4$), hydrogen ($H_2$) and contaminants resulting from a starting material of the plate and its coating.

The distribution of nitrogen with 78 vol-% and oxygen in the amount of 21 vol-% corresponds to the content of normal ambient air. The fraction of oxygen in the dried air may, for example, be increased through supply of pure oxygen. As the content of oxygen in the furnace atmosphere is reduced as a result of the formation of the oxide layer and possible combustion processes, the supply of dried air leads already to an increase in the oxygen content. The supply of dried air also reduces the proportion of nitrogen within the furnace atmosphere.

A method according to the present invention for heating a pre-coated steel plate with formation of an alloying layer for the production of hot formed body and structural parts reduces wear of the hot forming tool as a result of deposits and abrasion and attains sufficient oxidation of the coating while yet diminishing the risk of hydrogen embrittlement in an economical manner. In particular the use of generally available compressed air renders the process efficient to control the furnace atmosphere. The benefits, in particular the formation of a sufficient oxide layer to prevent or at least significantly reduce deposits on the shaping zones of the forming tool, can be realized simply by drying compressed air that is fed to the furnace. Furthermore, the risk of hydrogen embrittlement is significantly reduced as a result of the lower proportion of water in the form of hydrogen within the supplied air. The formed oxide layer is also less likely to separate so that dust buildup and accompanying wear of the forming tool is minimized.

According to another aspect of the present invention, an apparatus includes a furnace for heating a pre-coated plate, a drying assembly for pretreating air through drying, and a first feed line extending between a heatable interior space of the furnace and the drying assembly for supply of pretreated air from the drying assembly to the interior space while the pre-coated plate is in the furnace. As a result, pretreated air can be supplied to the interior space of the furnace via the drying assembly via the feed line.

The reduced fraction of water in the form of hydrogen within the furnace atmosphere as a result of undergoing a drying process reduces the risk of hydrogen embrittlement of the steel plate. Moreover, the oxygen content of the furnace atmosphere can be enriched with oxygen from the pretreated ambient air which oxygen content would otherwise be reduced within the furnace atmosphere especially by high temperatures.

According to another advantageous feature of the present invention, an air compressor can be connected to the drying assembly for compressing air which can be routed in a controlled way through the drying assembly via the feed line into the interior space. The air compressor is provided to conduct a certain volume of dried air in the form of a volumetric flow-rate into the interior space of the furnace. As a result, the required amount of proportions of dried air, especially of oxygen, can be controlled.

According to another advantageous feature of the present invention, the drying assembly can include at least two drying vessels which are alternatingly passed through by pretreated air. The presence of at least two drying vessels allows alternating circulation of required air. The alternating circulation of both drying vessels allows moisture accumulating in the drying vessel that is not circulated by air to be dried, for example by heating. The alternating charging of both drying vessels with drying air enables a continuous supply of air into the furnace.

According to another advantageous feature of the present invention, the feed line can be arranged in midsection of the interior space of the furnace. In particular, when configured as continuous furnace, the furnace has necessarily two openings, with one opening used for charging the furnace, and the other opening used for discharging the heated semi-finished product. Exchange of ambient air with the furnace atmosphere is possible near both openings. As a result, the proportion of oxygen in the interior space of the furnace in the region of the openings is higher than in the furnace region between the openings. The arrangement of the feed line in midsection of the interior space results in a substantially constant fraction of oxygen in the interior space of the furnace. The resulting positive effects of the formed oxide layer on the coating are thus realized across the entire length of the furnace.

According to another advantageous feature of the present invention, the furnace can include an exhaust duct which is thermally coupled, at least in an area thereof, with the feed line. Exhausts from at least one burner can thus be carried away. The exhaust duct can be arranged outside the interior space of the furnace. The thermal coupling may, for example, be realized via a heat exchanger. It is also conceivable to integrate the feed line, or at least an area thereof, in the exhaust duct. Heat of the exhaust air can thus be used to heat air fed to the interior space of the furnace.

As a result of structural separation within the heat exchanger, there is no exchange of the respective fluids. This allows adequate temperature control, especially heating of the supplied air, without added need for energy. The air being supplied can be heated to a temperature of 100° C. Air may generally be heated before, during, or after undergoing a drying process. The exhaust air heat air being fed to the furnace can be heated to a temperature from of 100° C. to 950° C., preferably to a temperature from 100° C. to 700° C. Currently preferred is a temperature from 100° C. to 500° C. Depending on the configuration of the heat exchanger, air being fed may also be heated to a temperature from of 100° C. to 200° C.

According to another advantageous feature of the present invention, the furnace may be configured in the form of a continuous furnace having at least two feed lines extending between the drying assembly and the interior space of the furnace. The feed lines may be spaced from one another by a distance which depends on the length of the continuous furnace. Typically, the two feed lines are spaced from one another at a distance of 2.0 to 3.0 m. Of course, more than two feed lines may be provided which may have, for example, smaller cross section and arranged in close proximity to one another. In any event, an even supply of dried air into the interior space of the furnace is desired, with the composition of air being constant and approximating the furnace atmosphere.

According to another advantageous feature of the present invention, the furnace can have at least one dew point sensor which can be coupled, at least indirectly, with the drying assembly. In this way, the furnace atmosphere can have a composition which is as constant as possible and independent on the respective temperature of air being dried. The dew point sensor may, for example, be arranged within the feed line. Advantageously, the dew point sensor is arranged in the interior space of the furnace in order to be able to ascertain the actual composition of the furnace atmosphere with respect to its dew point. For that purpose, the dew point sensor is coupled with the drying assembly. Coupling is used for control, in particular for an exchange of information between dew point sensor and drying assembly. Thus, the ascertained measuring variable by the dew point sensor can be used to control the drying action of the drying assembly with respect to air flowing there through. For that purpose, the dew point sensor may transmit periodically measured values to the drying assembly whose drying effect may be adjusted for example by an appropriate control.

Of course, the dew point sensor may be configured to provide continuous measurement so that the efficiency of the drying assembly can be continuously adjusted. The dew point sensor may be configured as a humidity sensor. The desired dew point of the furnace atmosphere is thus controlled by the combination of dew point sensor and drying assembly.

Examples of a drying assembly may include a refrigerant dryer or IR dryer. Currently preferred is the configuration of a drying assembly in the form of an adsorption dryer which may include, for example, a drying agent of activated aluminum oxide that has continuously high adsorption capability and good regeneration capability.

Even through the drying assembly can be configured to be time-controlled, it is advantageous to render it capacity-controlled to permit required adjustment of the desired dew point. The drying degree can be controlled across all phases of the drying cycle, like for example adsorption, pressure-relief, regeneration of the drying agent, and pressure buildup.

According to another advantageous feature of the present invention, the furnace can include at least two temperature zones which can be arranged in run-through direction and/or transversely to the run-through direction of the furnace. The different temperature zones are provided to permit a hot forming of parts of the steel plate. Thus, individual zones of the plate can be brought to the required temperature in order to adjust the required properties of the material during the subsequent hot forming, especially press hardening.

The individual temperature zones may, for example, be adjusted locally to different temperatures. Moreover, the individual temperature zones may have areas which can advantageously be adjusted and controlled through supply of pretreated air. Of course, a combination of temperature control and air supply is possible. In particular, the supply of pretreated air enables adjustment of local temperature conditions within a shortest possible time because their temperature lies oftentimes below the temperature of the furnace atmosphere. Depending on the configuration at hand, the individual temperature zones may be controlled through individual and for example increased supply of pretreated air.

Optionally, the supply of pretreated air may be configured in such a way that the pretreated air is routed along a longest possible path, for example by laying an alternating route, in the area of the exhaust air, in particular the exhaust duct of the burner. In this way, heat is transmitted from the exhaust air or exhaust gas onto the feed line and thus air that flows therein to heat the air. As a result, an undesired heat loss of the furnace atmosphere, especially an undesired cooling in the area of the feed lines to the interior space of the furnace can be compensated, at least in part. Thus, pretreated air is heated in a desired manner before being fed into the interior space of the furnace.

The feed lines may, optionally, also be arranged in such a manner as to form atmospheric zones in the interior space of the furnace.

According to another advantageous feature of the present invention, at least one of the temperature zones can have at least one area in which a temperature is adjustable by air supplied via the feed line. The temperature zone is arranged in the region of the feed line so as to be adjustable at least in some areas by the supply of air. Temperature of the temperature zone can be adjusted by the amount and temperature of air being fed in dependence on the volume of the temperature zone.

An apparatus according to the present invention for heating a pre-coated steel plate with formation of an alloying layer for the production of hot formed body and structural parts thus leads to a reduction in wear of the hot forming tool as a result of deposits and abrasion. In particular the controlled supply of air oxygen attains sufficient oxidation of the coating to reduce the adhering effect of deposits upon the shaping regions of the forming tool while yet diminishing the risk of hydrogen embrittlement in an economical manner as a result of the lower proportion of water in the form of water vapor in the furnace atmosphere.

Thus, existing furnaces and typical compressed air systems can be used, requiring only the presence of a drying assembly and at least one feed line to the interior space of the furnace. Especially the reduction of deposits upon the hot forming tool and of abrasion resulting from dust formation lowers overall maintenance works. Moreover, fewer ceramic rollers as components of a transport device in continuous furnaces are wasted as a result of the presence of the oxide layer on the coating to counter the formation of deposits.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
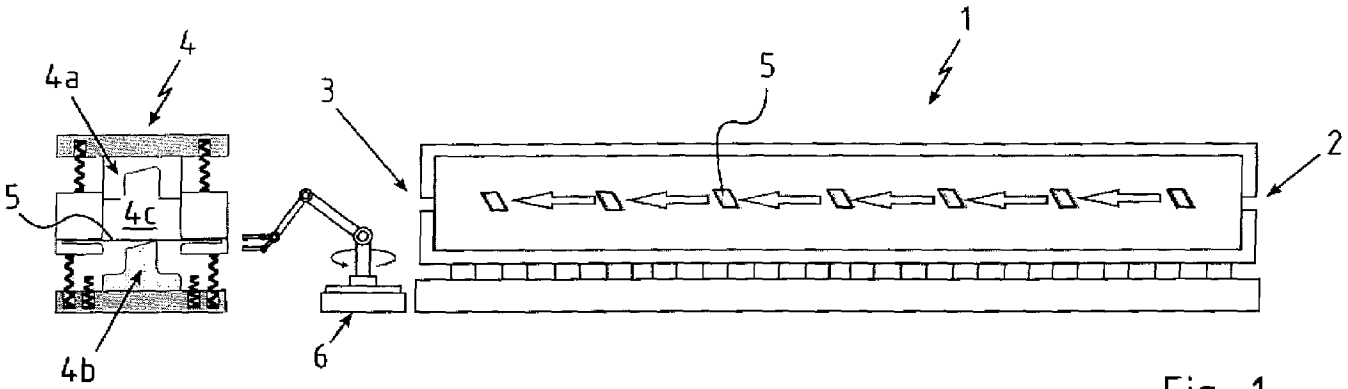
FIG. 1 is a side view of a furnace, configured in the form of a continuous furnace and embodying the subject matter of the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a side view of a furnace, generally designated by reference numeral 1 and configured in the form of a continuous furnace extending in a longitudinal direction. The furnace 1 has opposite ends, each formed with an opening, with the opening shown on the right-hand side of FIG. 1 representing an entrance 2 and the opposite opening representing an exit 3 of the furnace 1. A forming tool 4 is arranged in the region of the exit 3 of the furnace 1 and includes an upper die 4*a* and a lower die 4*b* between which a pre-coated plate 5 can be shaped. For that purpose, the forming tool 4 has a shaping zone 4*c* which is arranged between the upper die 4*a* and the lower die 4*b* and within which the plate 5 being shaped can be placed.

A manipulator 6 in the form of a robotic arm is arranged between the furnace 1 and the forming tool 4. The furnace 1 is provided to heat the preheated plate 5 of steel as the plate 5 is introduced into the furnace 1 via the entrance 2 and advances through the furnace 1 in the direction of the exit 3. As it moves through the furnace 1 and its furnace atmosphere, the pre-coated plate 5 is heated to an austenitization temperature of 700° C. to 950° C. in a manner not shown in detail for the sake of simplicity. As the plate 5 is heated, an intermetallic alloying layer forms between the coating of the plate 5 and the surface of the plate 5. Oxygen in the furnace atmosphere causes oxidation of the coating so that an oxide layer is formed on the surface of the coating. The coating may advantageously involve aluminum, especially an aluminum-silicon alloy.

The plate 5 has been heated to the austenitization temperature when removed from the furnace 1 at the exit 3. The plate 5 is then grabbed in a manner not shown in detail by the manipulator 6 and placed into the shaping zone 4*c* of the forming tool 4. Thereafter, the plate 5 is shaped, also in a manner not shown in greater detail, as the upper die 4*a* approaches the lower die 4*b* using a pressing force. The plate 5 is then cooled and hardened while still being in the shaping zone 4*c* of the forming tool 4.

In order to be able to cool down the shaped plate 5 within the forming tool 4 at a rate that is dependent on the respective alloy, the upper die 4*a* and/or the lower die 4*b* are provided with cooling means. For example, integrated cooling ducts may be provided through which a cooling fluid may circulate to absorb heat in the upper die 4*a* and/or lower die 4*b* and to carry it away.

In practice, the furnace 1 is continuously charged with pre-coated plates 5 via the entrance 2. Thus, the provision of plates 5 heated to austenitization temperature is made available continuously at the exit 3 of the furnace 1 for transfer to the forming tool 4 via the manipulator 6 and subsequent forming and press hardening.

Figure 2:
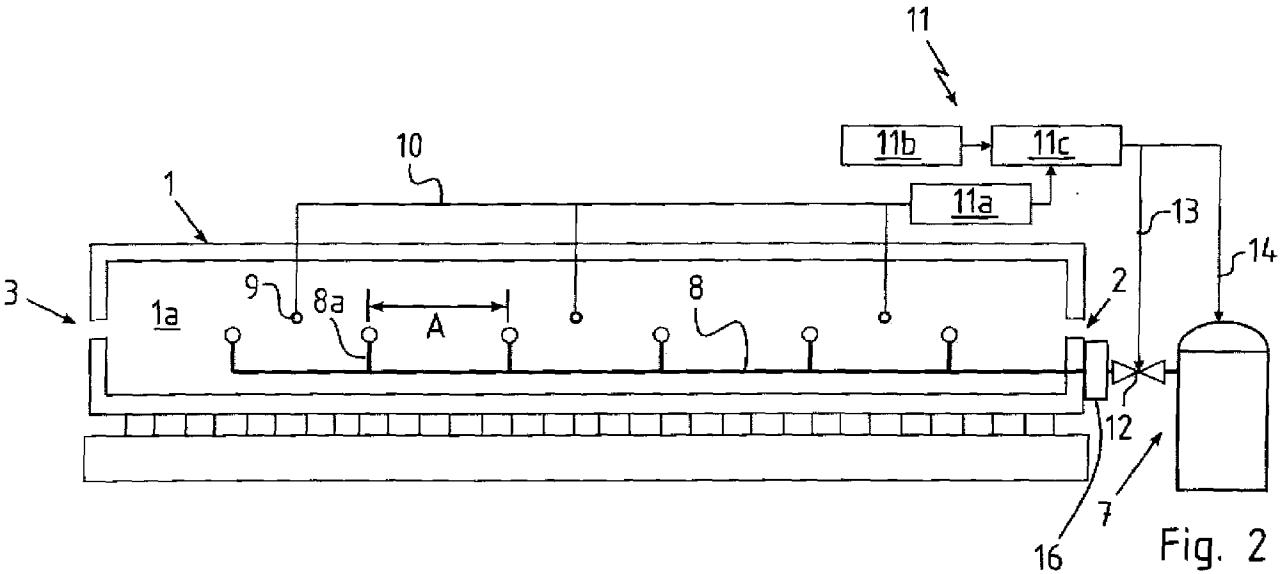
FIG. 2 is a side view of the continuous furnace of FIG. 1, illustrating components for supply of dried air.

FIG. 2 shows further details of the furnace 1. A drying assembly 7 is arranged outside the furnace 1 and includes at least one drying vessel, not shown in greater detail. The drying assembly 7 is connected to the interior space 1*a* of the furnace 1 via a central feed line 8 and further feed lines 8*a* arranged in spaced-apart relationship at a distance A. In addition, the furnace 1 includes several dew point sensors 9 which are connected by cable 10 with a control device 11. The control device 11 includes a measurement module 11*a* as well as an input module 11*b* and control module 11*c*. Of course, the connection between the dew point sensor 9 and the control device 11 may also be wireless.

The distance A between the feed lines 8*a* is dependent on the used burners, not shown in greater detail, in particular on the output of the burners and the corresponding burner tube thickness. For example, the distance A may range from 0.5 m to 2.5 m. The distance A may be calculated for example as three times the respective burner tube thickness. For example, when 50 kW burners are used with a burner tube thickness of 50 cm, distance A may amount to 1.5 m.

A controller 12 is arranged between the feed line 8 and the drying assembly 7 for controlling the amount of dried air exiting the drying assembly 7 and fed to the interior space 1*a* of the furnace 1. The control module 11*c* of the control device 11 is also connected by a cable 13 with the controller 12. In addition, the drying assembly 7 is connected by a cable 14 with the control module 11*c* of the control device 11. The connection of the controller 12 and/or drying assembly 7 with the control device 11 may principally also be wireless. Of course, the communication of the controller 12 and/or the drying assembly 7 with the control device 11 may be established via an appropriate BUS system.

Figure 3:
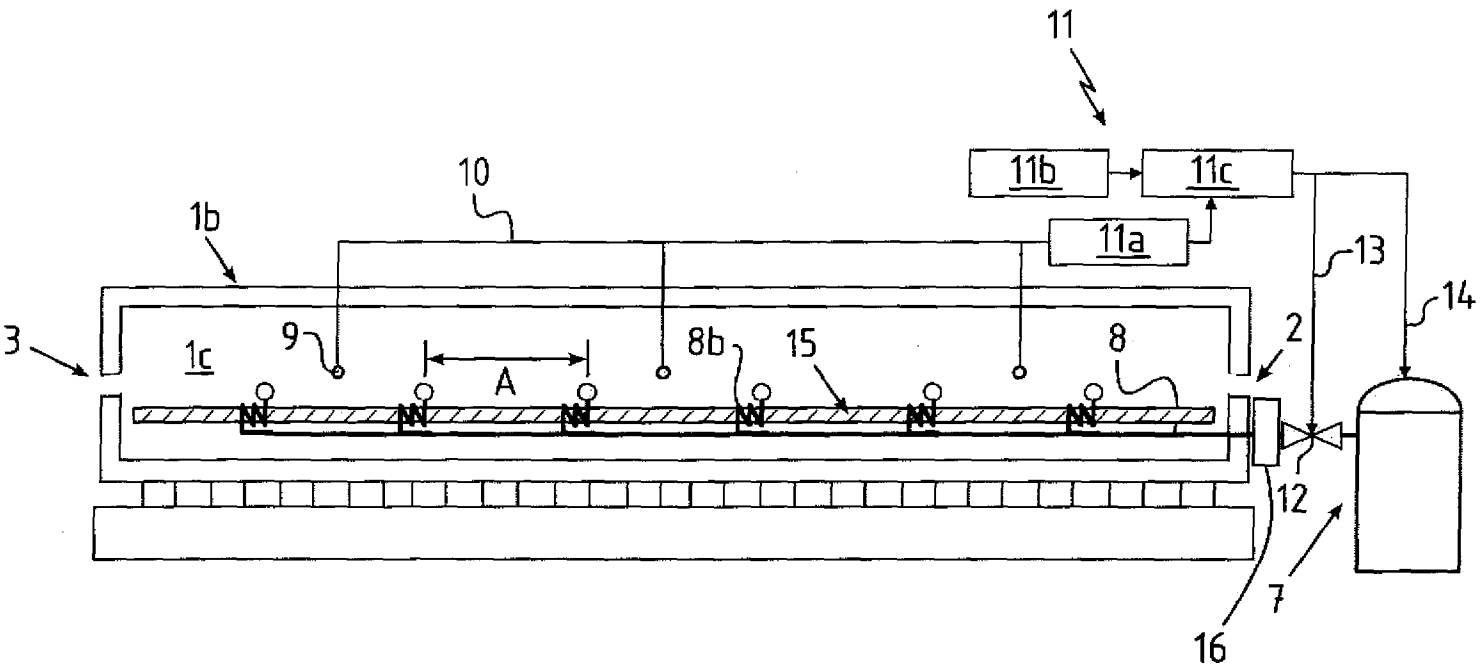
FIG. 3 is a side view of a modified continuous furnace with modified supply of pretreated air.

FIG. 3 shows an alternative configuration of a furnace, generally designated by reference numeral 1*b*. Parts corresponding with those in FIGS. 1 and 2 are denoted by identical reference numerals and not explained again. The description below will center on the differences between the embodiments. In this embodiment, provision is made for a modified configuration of the supply of the pretreated air in the interior space 1*c* of the furnace 1*b*. The central feed line 8 connected with the drying assembly 7 via the controller 12 communicates with feed lines 8*b* which are also arranged at distance A and connected with the interior space 1*c* of the furnace 1*b*. In order to heat the pretreated air before introduction into the interior space 1*c* of the furnace 1*b*, the feed lines 8*b* are arranged alternatingly and/or helically about a hot exhaust duct 15 of a burner, not shown in greater detail. The feed lines 8*b* operate hereby as heat exchanger so that the pretreated air is heated inside the feed lines 8*b* in the area of the exhaust duct 15 before being routed into the interior space 1*c*. In this way, existing heat can be utilized to heat pretreated air to the desired temperature without requiring added energy.

The dew point sensors 9 ascertain the actual dew point of the furnace atmosphere prevailing in the interior space 1*a*, 1*c* of the furnace 1, 1*b*. The ascertained values are transmitted via the cable 10 to the measurement module 11*a* of the control device 11. The desired value stored in the input module 11*b* of the control device 11 is compared with the actual values measured as controlled variable by the dew point sensors 9 and transmitted to the measurement module 11*a*. If adjustment is necessary, the controller 12 is activated via the cable 13 and/or the drying assembly 7 is activated as control element via the cable 14 by the control module 11*c* of the control device 11 in order to best suit the volumetric flow-rate of dried air into the interior space 1*a*, 1*c* and/or the drying power of the drying assembly 7.

In order to feed the required amount of dried air into the interior space 1*a*, 1*c*, the drying assembly 7 is connected either with a compressed air system, not shown in greater detail, or with an air compressor 16, as shown by way of example in FIGS. 2 and 3. In this way, the drying assembly 7 is charged with ambient air at a pressure above atmospheric pressure, which ambient air is then dried in the drying assembly 7 and fed via the feed lines 8, 8*a*, 8*b* into the interior space 1*a*, 1*c* of the furnace 1. The thus-fed pretreated compressed air escapes via at least one of the openings of the furnace 1, i.e. the entry 2 and/or the exit 3.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A method, comprising:

heating a pre-coated plate of steel to a temperature of 700° C. to 950° C. in a furnace to form an intermetallic alloying layer on the plate at least in an area thereof;

pretreating air through drying to produce dried air having a dew point adjusted to a value of −70° C. to +10° C.;

heating the dried air before being fed to the furnace to a temperature from 100° C. to 700° C., feeding dried air into the furnace under pressure above atmospheric to control an atmosphere within the furnace while the pre-coated plate is in the furnace; and wherein the dried air is fed to the furnace with the pressure of the dried air being adjusted to a value between the atmospheric pressure and 8 bar inclusive.

2. The method of claim 1, further comprising transferring the pre-coated plate from the furnace for use in the production of a hot formed body or structure of a motor vehicle.

3. The method of claim 1, wherein the plate is made of a steel alloy having a carbon fraction of 0.15 weight-% to 2.0 weight-%.

4. The method of claim 1, wherein the dried air has a dew point adjusted to a value between −70° C. to +5° C.

5. The method of claim 1, wherein the dried air has a dew point adjusted to a value between −30° C. to +0° C.

6. The method of claim 1, further comprising wherein the heating the dried air before being fed to the furnace includes heating the dried air to a temperature from 100° C. to 500° C.

7. The method of claim 1, further comprising adjusting a volumetric flow-rate of the dried air, passing the furnace during heating of the plate, to 2.5 times a furnace volume per hour.

8. The method of claim 7, wherein the adjusting a volumetric flow-rate of the dried air, passing the furnace during heating of the plate includes adjusting the volumetric air flow of the dried air to 3 times the furnace volume per hour.

9. The method of claim 7, wherein the adjusting a volumetric flow-rate of the dried air, passing the furnace during heating of the plate includes adjusting the volumetric air flow of the dried air to 6 times the furnace volume per hour.

10. The method of claim 1, further comprising adjusting the atmosphere within the furnace to have a composition comprising:

nitrogen ($N_2$)≤85 vol-%;

oxygen ($O_2$) from 10 vol-% to 21 vol-%;

water vapor ($H_2O$ vapor)<3 vol-%, and remainder comprising carbon monoxide (CO), carbon dioxide ($CO_2$), methane ($CH_4$), hydrogen ($H_2$) and contaminants resulting from a starting material of the plate and its coating.

11. The method of claim 10, wherein the adjusting the atmosphere within the furnace includes adjusting the atmosphere to have the composition comprising nitrogen ($N_2$) 79 vol.-%.

12. The method of claim 10, wherein the adjusting the atmosphere within the furnace includes adjusting the atmosphere to have the composition comprising oxygen ($O_2$) from 15 vol-% to 21 vol-%.

13. The method of claim 10, wherein the adjusting the atmosphere within the furnace includes adjusting the atmosphere to have the composition comprising oxygen ($O_2$) 21 vol-%.

* * * * *